US005216772A

United States Patent [19]

Clute

[11] Patent Number: 5,216,772

[45] Date of Patent: Jun. 8, 1993

[54] SUPPORT PILLOW

[76] Inventor: L. Jason Clute, 3555 Shadow Creek Dr., Danville, Calif. 94506

[21] Appl. No.: 977,162

[22] Filed: Nov. 16, 1992

Related U.S. Application Data

[63] Continuation-in-part of Ser. No. 934,256, Aug. 25, 1992, Pat. No. 5,193,238.

[51] Int. Cl.[5] ..... A47C 20/02

[52] U.S. Cl. ..... 5/655; 5/630; 5/657; 5/638; 5/461

[58] Field of Search ..... 5/630–632, 5/652, 657, 465, 490, 638, 461

[56] References Cited

U.S. PATENT DOCUMENTS

| | | | |
|---|---|---|---|
| 1,295,770 | 2/1919 | Lamont . | |
| 2,562,725 | 7/1951 | Leto et al. . | |
| 3,135,974 | 6/1964 | Roman | 5/461 |
| 3,339,216 | 9/1967 | Ormerod | 5/461 |
| 4,506,396 | 3/1985 | Ritchie, Jr. et al. . | |
| 4,579,111 | 4/1986 | Ledesma . | |
| 4,733,836 | 3/1988 | Barnes . | |
| 4,790,041 | 12/1988 | Shtull . | |
| 5,165,130 | 11/1992 | Wendling | 5/655 |
| 5,182,828 | 2/1993 | Alivizalos | 5/632 X |

FOREIGN PATENT DOCUMENTS 1449012 7/1966 France .

*Primary Examiner*—Michael F. Trettel

[57] ABSTRACT

A support pillow in two main sections, each section having an elongated resilient foam member each covered with fabric with a portion of the fabric extending outward to define a flexible panel. The top surface of one panel, and the bottom surface of the other panel are affixed with elongated hook and loop fastening strips which allow adjustable overlapping affixment of the two panels one to another in order to affix together the two sections of the support pillow. The two sections of the support pillow when affixed together define an open-ended and open-top vertical walled channel with the panels and fabric covered foam members providing an anti-roll device for the infant. The hook and loop attachment of the two panels provides for adjustability in the distance between vertical side walls of the channel. An infant may be placed on its side, on top of the overlapped rectangular panels with the vertical side walls of the support pillow positioned snugly against the chest and back of the infant, with the infant's torso within the channel. The support pillow assists in stabilizing and maintaining the infant comfortably in a lateral sleeping position. An elongated lengthwise recess is formed into each vertical side wall facing the channel to define a ventilation system which includes an excluding arrangement for excluding an infant's face from fully entering the recess and the infant's nose and mouth from engaging a wall defining the recess.

12 Claims, 8 Drawing Sheets

SUPPORT PILLOW

This is a continuation-in-part of my U.S. application Ser. No. 07/934,256 filed Aug. 8, 1992, now U.S. Pat. No. 5,193,238 of which the benefit of the earlier filing date for the common material is claimed.

BACKGROUND OF THE INVENTION

1. Field of the Invention:

The present invention relates to support pillows for humans in general, and in particular to a pillow which supports and maintains the torso of an infant generally stationary while sleeping.

2. Description of the Prior Art:

There have been studies in the past which provide some evidence that supporting infants in certain positions during sleep may help to prevent the occurrence of Sudden Infant Death Syndrome, commonly referred to as SIDS. Some of the most recent information indicates that positioning the infant in a lateral position (on its side) during sleep may be the most desirable and helpful position in reducing the occurrence of SIDS. At this time there is no definitive diagnosis of the cause of SIDS, and it remains a serious problem with no known cure. Some theorize the infants simply suffocate possibly due to their not having enough strength to raise their heads off the mattress when in a prone position in order to avoid whatever obstacle is blocking their breathing. SIDS is more prevalent in the first six months of the infant's life, which adds support to the theory that the infant's underdeveloped motor skills may be a factor in SIDS deaths. Some believe placing infants on their backs can also be dangerous if they regurgitate formula and subsequently aspirate it into their lungs.

In the past, some parents have positioned infants on their sides with the use of bed pillows or rolled blankets propped against the back and or front of the infant, primarily for the purpose of allowing the infant to nurse from a bottle more easily. However, bed pillows and rolled blankets tend to become easily dislodged as the infant moves about, and are generally ineffective in maintaining the infant in a true lateral position. The dislodged bed pillows and blankets also pose the potential danger of covering the infant's face and interfering with its breathing. Another problem with bed pillows and blankets, particularly during warm summer months, is with the infant becoming excessively hot due to the heat trapping capabilities of bed pillows and blankets. None of the prior art support pillow arrangements are properly adjustable to accommodate the various sizes of infants, or are readily portable, machine washable, or provide sufficient heat dissipation capabilities for summer use. Additionally, none of the prior art support pillow arrangements are properly structured to ensure the safety of the infant, particularly in preventing the possibility of the infant's nose and mouth from being blocked by a portion of the pillow and hindering his normal breathing. Therefore there is a significant need for a suitably structured improved support pillow particularly for use with infants.

SUMMARY

The present invention is a support pillow primarily for use with infants, to maintain an infant on its side during sleep and thus hopefully reduce the risk of SIDS, while also providing an acceptable level of comfort, safety, and convenience of use. My support pillow includes two preferably detachable main sections. Each main section is preferably structured of an elongated wedge or right-triangular shaped resilient foam rubber member each preferably covered with a flexible thin sheet material to define right-triangular pads. The thin sheet material may be a soft fabric or the like which is washable, or may be thin sheeting material which is disposable, such as the fiber filled paper-like materials such as those often used in hospitals for disposable gowns. I have also considered using plastic sheeting which may or may not be perforated. The thin sheet material of each triangular member preferably extends from and beyond one lateral edge thereof to define a thin flexible rectangular panel. The two main sections of the pillow are adjustably affixable together along the rectangular panel portions with the use of attached elongated strips of hook and loop fasteners utilized to connect the two rectangular panels when overlapping one another. When affixed together, the two main sections of the support pillow define an open-ended and open-top channel with the rectangular panels and flat bases of the triangular pads defining a flat bottom to prevent the pillow and baby from rolling on a surface, and with the triangular pads additionally defining two spaced apart vertically oriented side walls of the channel. The space between the vertically oriented side walls of the channel is adjustably stabilized by the affixed together overlapped panels which prevent undesired spreading of the triangular pads or members. Under certain conditions, the overlapped panels might be eliminated and replaced by nonskid bottoms such as rubber mats on each triangular member or pad, which might sufficiently stabilize the vertical side walls of the channel relative to one another, however, the overlapped rectangular panels are preferred since they are quite positive. The vertical side walls are preferably straight, parallel, and effectively planar. An infant may be placed on its side, on top of the overlapped rectangular panels which define the bottom of the channel, with the vertical side walls of the support pillow positioned snugly against the chest and back of the infant, with the infant's torso within the channel. The infant's head extends out one open end of the channel, and his legs extend out the other oppositely disposed open end of the channel. The hook and loop fasteners on the overlapped panels allow the distance between two vertical sides of the triangular pads to be adjusted in spacing by adjusting the overlap of the two rectangular panels, and thus adjusting the width of the channel, with this being to accommodate for varying widths of infants, and for gradual increases as an infant grows. The hook and loop fasteners which affix the two main sections together allow for very small increment adjustments in the width of the channel, and therefore are preferred to a series of snaps or buttons which might also work. The side walls defining the channel provide vertical, effectively planar surfaces which when pressed snugly against the generally flat back side and front side of the infant, with the infant lying on its side, prevent the infant from rolling or turning within the channel, and this without requiring an uncomfortable level of pressure applied to the baby by the side walls of the support pillow.

Structuring for providing proper body alignment for the infant includes the longitudinal length of the pillow extending from about the infant's shoulders to its buttocks, and the pad extending in height to just below or level with the infant's shoulder while laying on its side. The structural composition of the support pillow, and specifically the triangular pads, is developed to be soft and resilient for comfort, yet rigid or firm enough to provide support when properly adjusted to fit snugly against the baby. The support pillow is also structured to allow free movement of the infant's legs, when desired, allowing the baby to lay in a fetal or semi-fetal position.

Although newborn infants do not have the strength and dexterity to significantly reposition themselves, they do at times seem to be able to scoot about for short distances. Primarily this minor scooting movement is created by the random kicking of their legs, which tends to push them forward. Although there is little danger of the infants scooting rearward into the support pillow, precautions have still been taken to avoid this occurrence. One optional element of the invention aimed towards reducing the possibility of slippage of the infant is the possible addition of a strap which is placed over the infant's side, securing him in position within the support pillow. The optional strap includes connectors which allow for adjustable tension over the baby.

To further reduce slippage of the infant within the channel, the thin sheet covering of the pillow is preferably manufactured of a non-slick thin sheet material which will provide frictional adhesion against the infant's clothing in the area of the channel, and frictional adhesion between the flat bottom of the support pad and whatever surface the support pillow is placed upon. Terry-cloth and flannel have been found to function well as thin sheet materials which are both washable and soft. It is also suggested for the excessively active newborn that the infant's torso be wrapped or swaddled in a receiving blanket to avoid major leg movement. Swaddling newborn infants is a well known and widely accepted procedure practiced in many hospitals today. It has been found to be calming to them, presumably since it may resemble the infant's condition prior to birth and therefore makes them feel more secure. With my support pillow, because it is sufficiently short to leave the legs free, an infant can still bend its legs somewhat while in the support pillow, thereby being more comfortable.

To prevent over heating of the infant, and reduce the risk of the infant's breathing from being blocked, another feature of the present invention is a ventilation system to provide air circulation for the infant's torso. The ventilation system includes a face or nose and mouth excluding arrangement. The ventilation system comprises an elongated recess preferably provided in each of the vertical side walls of the triangular foam members. The elongated recesses may be covered with a porous thin sheet material through which air passes easily. The porous thin sheet material is stretched rather tightly over the recesses in the vertical side walls, and therefore the ability of the effectively planar, straight vertical side walls within the channel to prevent the baby from rolling is maintained. Additionally, if in the very unlikely event the infant should slide down in between the two pillow sections, the recess of the ventilation system will also provide space through which the infant will be easily able to breathe should his face be pressed against the pillow, and this without having to breathe the same oxygen depleted air, and this is believed to be a major safety aspect of the present invention provided by the ventilation system. An alternative to the use of the porous thin sheet material over the recess, is to size and place the recess in a manner so as to exclude the nose and mouth of the infant from pressing against any non-porous surface of the support pillow which might hinder his breathing.

My support pillow is structured for convenient use, being small and light weight enough to be easily portable within a conventional diaper bag and also easy to keep clean. These are significant features since traveling with a child already involves transporting a large variety of articles, and being able to carry the support pillow within a diaper bag is a major convenience. The overall small size of the pillow is important in that it can be easily used within cribs, cradles and even infant carriers. The washability of the support pillow, or ease of replacing and or washing soiled parts thereof, is also a concern addressed with my invention, since items coming in close contact with the child can often become soiled, it is important that they be quickly and easily cleaned to avoid infecting the child. Since the support pillow may be manufactured of conventional material, it can be easily provided in a variety of decorative colors and patterns to coordinate with the child's room decor, which would more than likely be a significantly important feature to the mother of the child. The general low cost of materials of which the invention may be manufactured, and the ease of assembly, should enable my support pillow to be provided at a relatively low price to the consumer.

Although the size of my support pillow in a small size for infants is adjustable to accommodate just about any size of infant, my support pillow could conceivably be manufactured of a size suitable for adults such as those under convalescent care. The major emphasis on the use of my support pillow is however during the first three to six months of life when the infant's motor skills are at their weakest, and it is therefore primarily sized for newborns.

DESCRIPTION OF PREFERRED EMBODIMENTS

Figure 1:
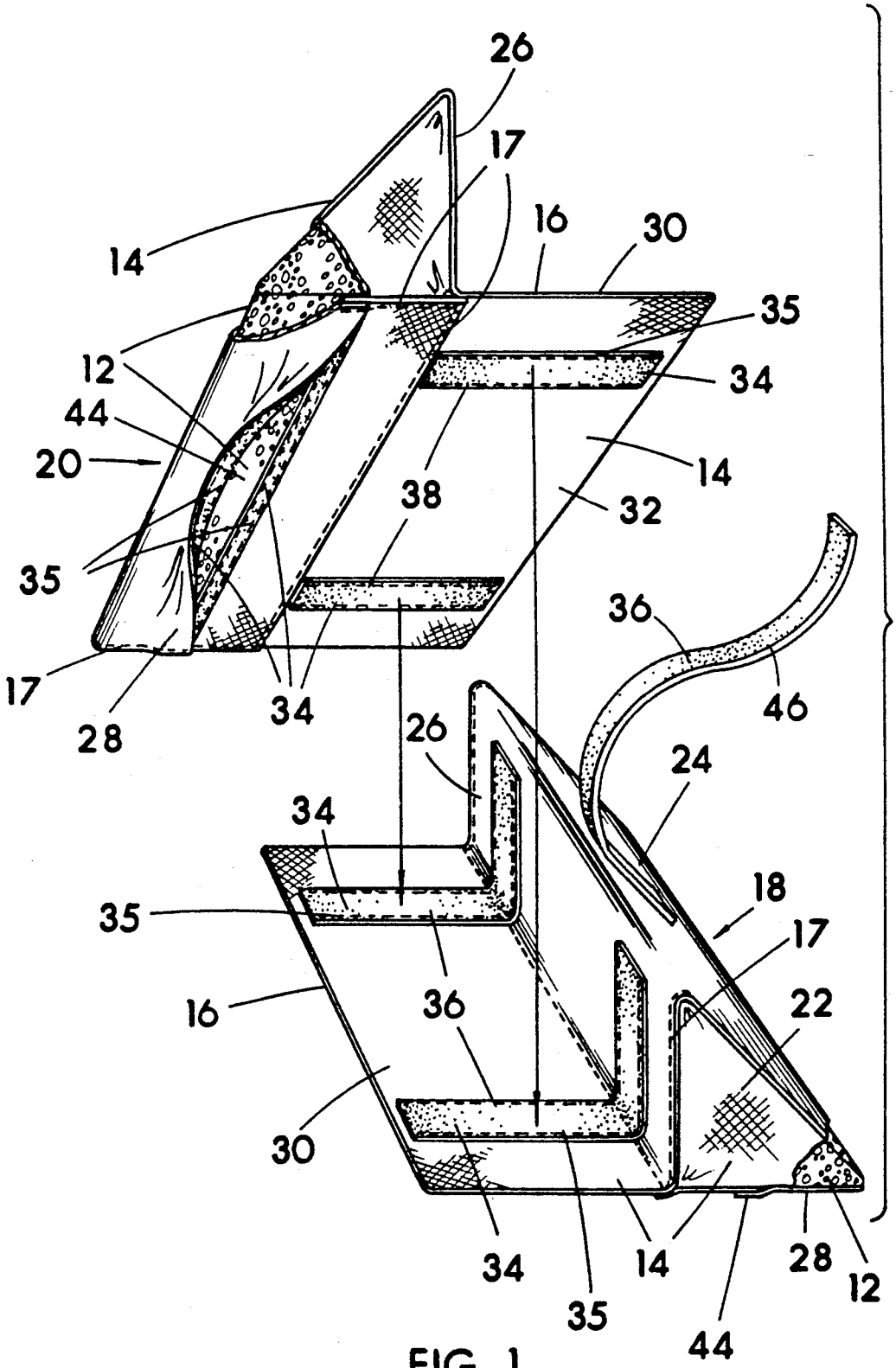
FIG. 1 is an exploded perspective view of an embodiment of my support pillow having the two detachable main sections.
Figure 2:
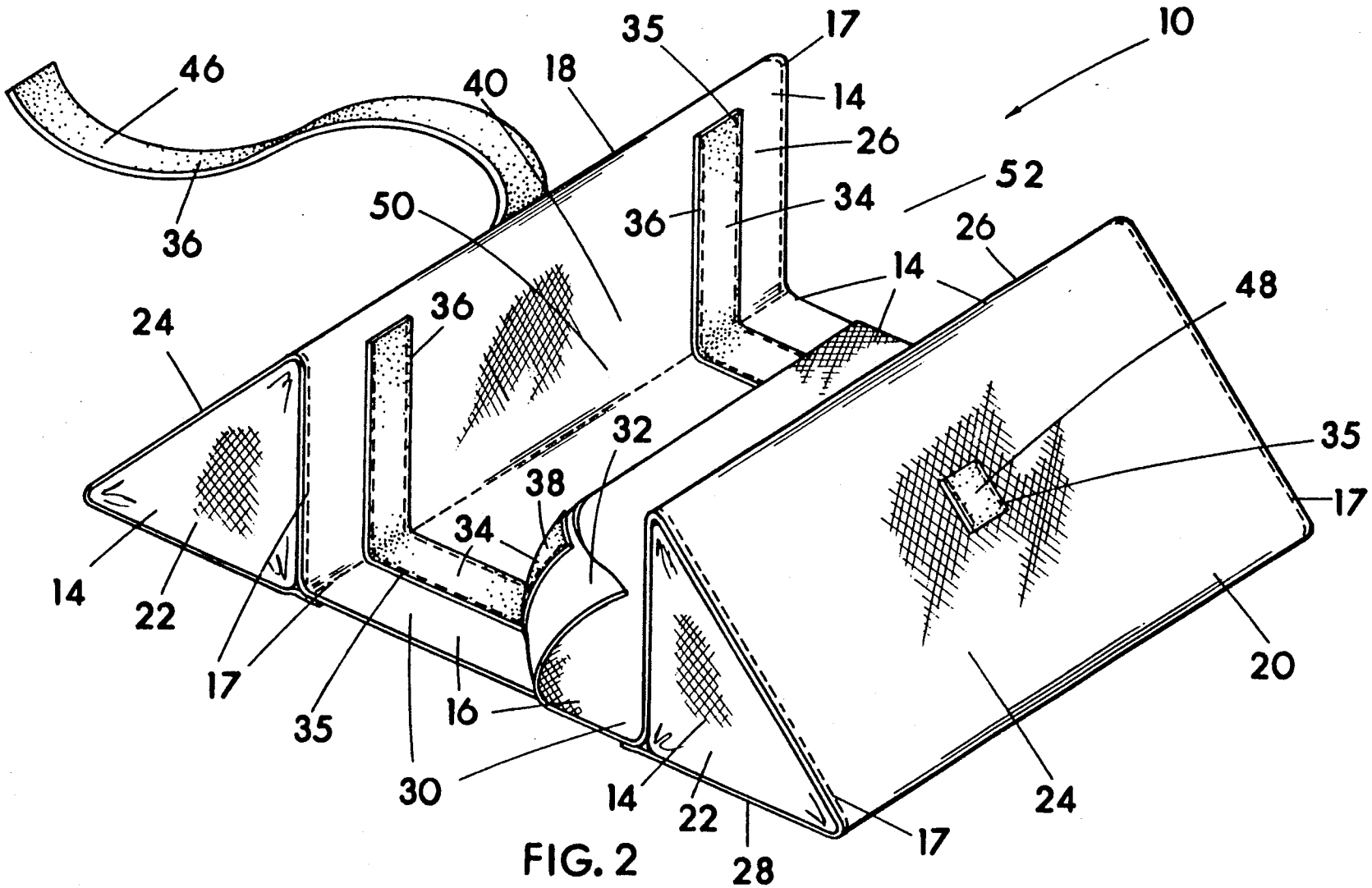
FIG. 2 is a top perspective view of the embodiment of my support pillow of FIG. 1 with both main sections attached to one another.
Figure 3:
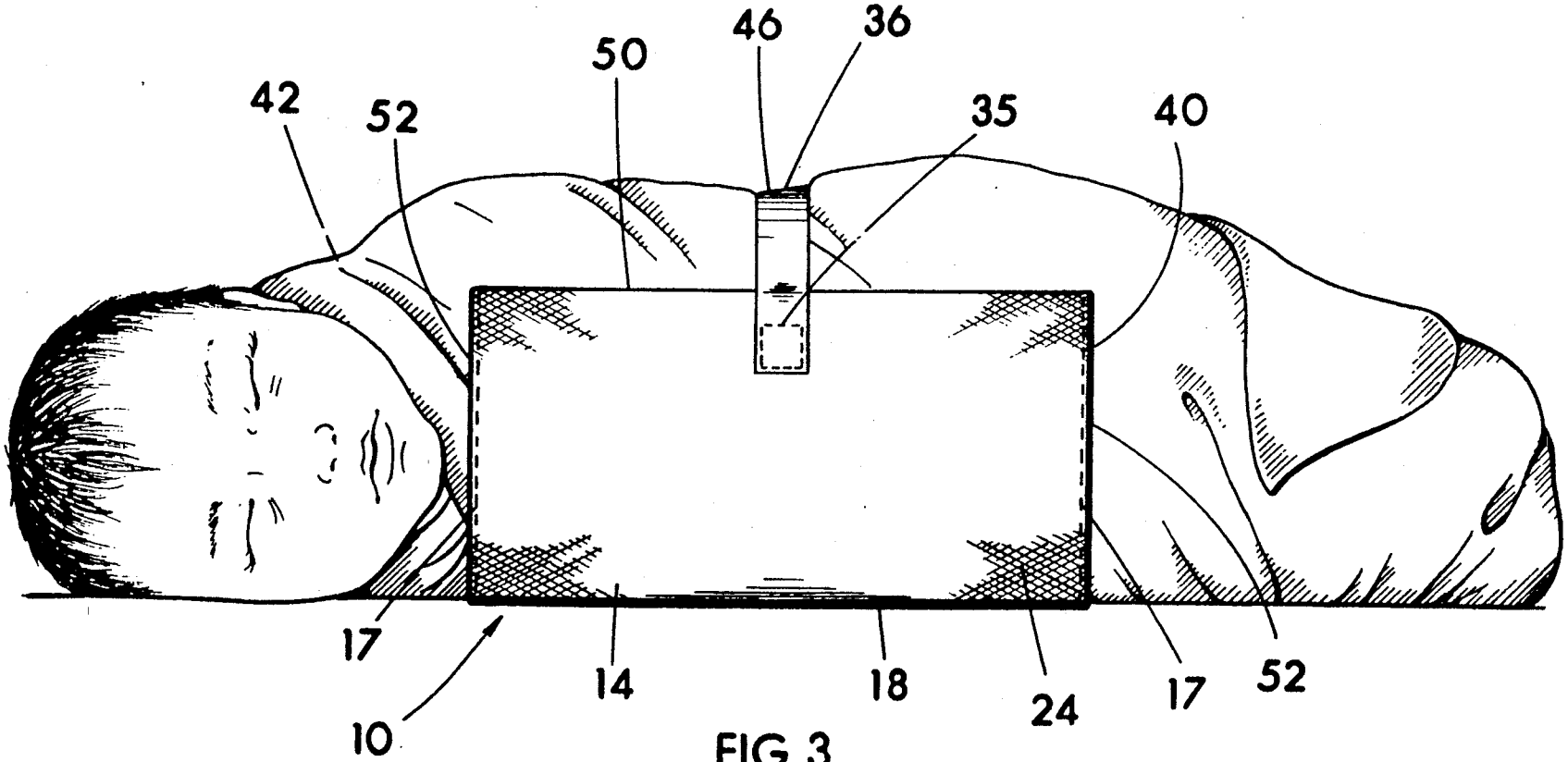
FIG. 3 is a side view of my embodiment of support pillow of FIG. 1, shown in-use supporting an infant on its right side.
Figure 4:
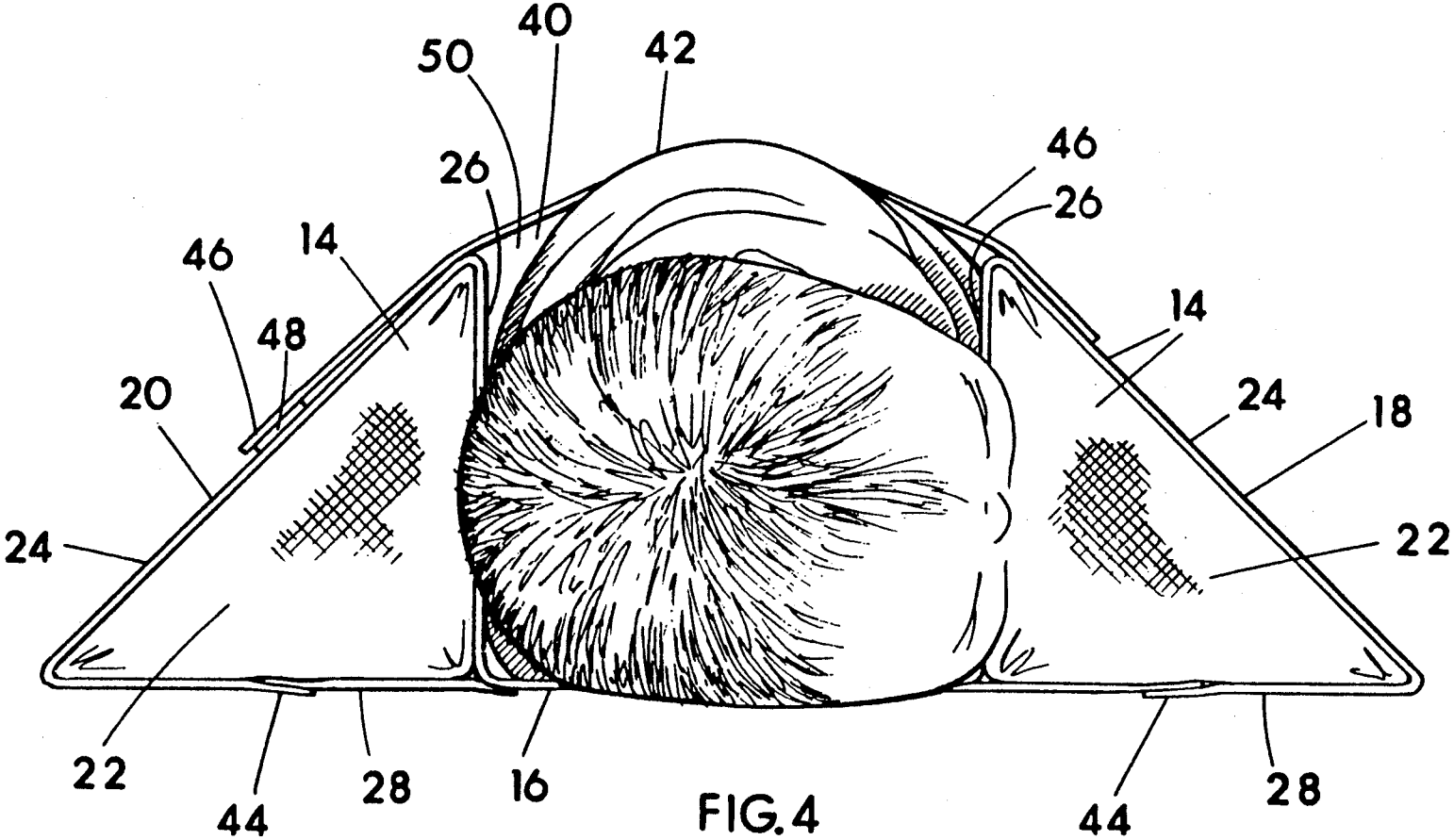
FIG. 4 is an in-use end view of my embodiment of support pillow of FIGS. 1 and 2, showing the head and shoulders of the infant with the chest and back of the infant supported by the flat vertical side walls.

Details of structural embodiments which are within the scope of the invention will now be described by way of example, but for the sake of briefness, these details are not an exhaustive recitation of all possibilities within the scope of the invention, and therefore are not meant to overly limit the true scope of the present invention. Referring to the drawing FIGS. 1 through 4 where a first embodiment of my support pillow 10 is illustrated for example. Support pillow 10 is structured of two adjustably affixed main sections 18 and 20 which are detachable from one another, each of which include two elongated triangular resilient foam members 12 which form right triangles when viewed endwardly. Foam members 12 are made of what is commonly referred to as foam rubber which in most cases is a foamed synthetic plastic which remains flexible and resilient. Although foam members 12 could also be other shapes, such as an elongated rectangle, the triangular shape reduces the bulk and amount of foam and materials required to manufacture support pillow 10. The triangular foam members 12 could be made of a variety of flexible and resilient materials including cotton or fiber batting or any suitably soft and resilient material which is sufficiently rigid to provide support. Both foam members 12 each have an outer layer or wrapping of thin flexible sheeting, or fabric covering 14, which extends over the lateral surfaces of foam member 12 and also extends outward from the right angled corner of foam member 12 to form rectangular panel 16. Fabric covering 14 also covers both ends of foam members 12, and is affixed in position with conventional methods such as sewing or adhesives, although the creation of permanently sewn seams 17 is preferred. Fabric covering 14 preferably consists of a loose weave material such as flannel or terry-cloth which provides a non-slip surface and is somewhat absorbent to prevent moisture condensation when it comes in contact with the skin.

The two assembled main sections of support pillow 10, main section 18 and main section 20, are each structured with two parallel oppositely disposed vertical end walls 22, an angled lateral side wall 24, a planar lateral vertical side wall 26 connected to a flat longitudinal horizontal base 28. Rectangular panel 16 extends from and beyond the intersection of lateral vertical side wall 26 and longitudinal horizontal base 28, and rectangular panel 16 lays in the same basic plane as the flat bottom of longitudinal horizontal base 28. Lateral vertical side wall 26 is connected to longitudinal horizontal base 28 at ideally a 90 degree angle or vertical to the horizontal base 28, but I have had relatively good results with lateral vertical side wall 26 laying anywhere in between 75 and 105 degrees relative to the horizontal base 28. Rectangular panel 16 has a top surface 30 which primarily faces upward in use, and an oppositely disposed bottom surface 32 which faces downward and rests on a supporting surface, such as a bed.

Both main sections 18 and 20 are releasably and adjustably affixed together with the use of two elongated hook and loop fastening strips 34. Each hook and loop fastening strip 34 includes two mating strips; one a softer looped section 36 and the other a coarser hooked section 38, the two of which releasably adhere to one another when pressed together. The two softer looped sections 36 of hook and loop fastening strips 34 are affixed transversely onto top surface 30 of panel 16 and onto lateral vertical side wall 26 of main section 18, one affixed near each end wall 22. Each looped section 36 runs transversely from adjacent the lateral distal edge of panel 16 of main section 18 to adjacent the top lateral edge of vertical side wall 26. The two coarser hooked sections 38 of hook and loop fastening strips 34 are affixed transversely to bottom surface 32 of panel 16 of main section 20, one near each end wall 22, and are longitudinally aligned with both looped sections 36 affixed to main section 18. Hook and loop fastening strips 34 are preferably affixed to support pillow 10 using the conventional method of stitching 35, although other suitable methods such as adhesives can also be used. The hook and loop fasteners of the rectangular panels 16 of the main sections 18 and 20 are positioned and sized relative to one another and relative to the vertically disposed side walls 26 so as to allow for small increment adjustments in the spacing between the vertically disposed side walls 26 and thus in the width of the channel 40.

Affixed to the angled side wall 24 of main section 18 is an optional adjustable attachment strap 46. Attachment strap 46 is preferably structured of an elongated section of the looped section 36 of hook and loop fastening strips 34. Strap 46 is endwardly affixed, preferably with stitching 35, to the central surface of angled side wall 24 of main section 20, with the soft looped surface facing downward. The distal end of strap 46 is then affixed to strap connector 48 which is structured of a short rectangular section of hooked section 38 of hook and loop fastening strips 34. Strap connector 48 is similarly affixed with stitching 35 to the central surface of angled side wall 24 of main section 18. Since strap 46 is structured entirely of looped section 36, it can be attached anywhere along its length to strap connector 48 thereby being adjustable to accommodate a variety of sizes of infants 42.

Depending upon the materials utilized for manufacture, the assembled support pillow 10 can be machine washed and dried as a unit, or if desired, foam members 12 can be removed from fabric covering 14 through pocket opening 44. Pocket opening 44 is located on the central surface of horizontal base 28 of both main sections 18 and 20. Pocket opening 44 runs lengthwise between both end walls 22 and is closable with hook and loop fastening strips 34, although other suitable attachments such as zippers can be used, or even just overlapped fabric without a fastener might work. Since fabric covering 14 forms the edges of pocket opening 44, pocket opening 44 can be stretched apart, due to the inherent flexible nature of fabric covering 14, to allow the removal of foam member 12. Foam members 12 are also malleable and can be easily manually compressed for insertion and removal from pocket opening 44.

To affix both main sections 18 and 20 together, main section 18 is positioned on a flat surface, such as a mattress, with loop section 36 on top surface 30 of panel 16 facing upward. Main section 20 is positioned over main section 18 with both panels 16 of both main sections 18 and 20 aligned, and both foam members 12 positioned parallel to one another. Panel 16 of main section 20 is then lowered onto top surface 30 of panel 16 of main section 18, mating the corresponding hook and loop fastening strips 34 affixed together. Once attached, the combined main sections 18 and 20, or assembled support pillow 10, creates a channel 40 into which infant 42 is placed lengthwise on its side. Channel 40 is therefore defined by both planar vertical side walls 26 and at least one panel 16, leaving channel 40 with an open top 50 and two oppositely disposed open ends 52.

By being transversely affixed onto both panels 16, hook and loop fastening strips 34 allow adjustments in the width of channel 40. To narrow channel 40 or decrease the distance between the two adjacent vertical side walls 26 of both main sections 18 and 20, both panels 16 are separated, then panel 16 of main section 20 is folded longitudinally upward. This vertical folded portion of panel 16 is affixed onto looped sections 36 of hook and loop fastening strips 34 on vertical side wall 26 of main section 18. The remaining horizontal portion of panel 16 of main section 20 is affixed onto the top surface 30 of main section 18 and secured to the remaining corresponding portions of hook and loop fastening strips 34. This procedure is used to create a narrower channel 40 to accommodate the smaller infants 42 or newborns. Once infant 42 is placed in channel 40, through open top 50, optional strap 46 is then placed over infant 42 and connected to strap connector 48 to prevent infant 42 from slipping downward within channel 40 through open ends 52.

To accommodate larger infants 42, channel 40 is widened. To accomplish this, both panels 16 are separated and then reattached towards the distal lateral edges of both panels 16. Only a small portion of the ends of both mating sections 36 and 38 need to be affixed to provide sufficient contact to prevent both panels 16 from separating during normal use. Although widening channel 40 may leave a large portion of looped sections 36 of hook and loop fastening strips 34 exposed on the surface of vertical side wall 26 of main section 18, looped sections 36 are soft and will not be abrasive to infant 42.

Support pillow 10 can be provided with openable end walls 22, closeable with hook and loop fastening strips 34 or zippers, for an alternate method of removal of members 12. Fabric covering 14 can also be eliminated altogether from one or both end walls 22 for removal of members 12, eliminating the need and cost of pocket opening 44. With this embodiment however, foam members 12 would preferably be provided with a non-porous, water repellant outer covering, since both ends of foam members 12 would be exposed. This would make removal and re-insertion of foam members 12 easier and cleaning could include simple wiping with a detergent and or disinfectant, with the removed fabric covering 14 being separately machine washable and dryable. In another anticipated embodiment of the invention, foam members 12 are simply permanently enveloped within fabric covering 14, and not removable therefrom, in which case the entire unit is washed as an assemblage. In another anticipated embodiment of the invention, fiber batting such as cotton, and paper are used to define member 12 and covering 14 respectively, and this embodiment is believed might be inexpensive enough to be considered to be disposable when the unit becomes soiled. This disposable embodiment could still utilize a strap 46 for securing the baby, and could still use hook and loop fasteners on the rectangular panels for attaching the main sections of the pillow adjustably together as with embodiment 10.

Figure 5:
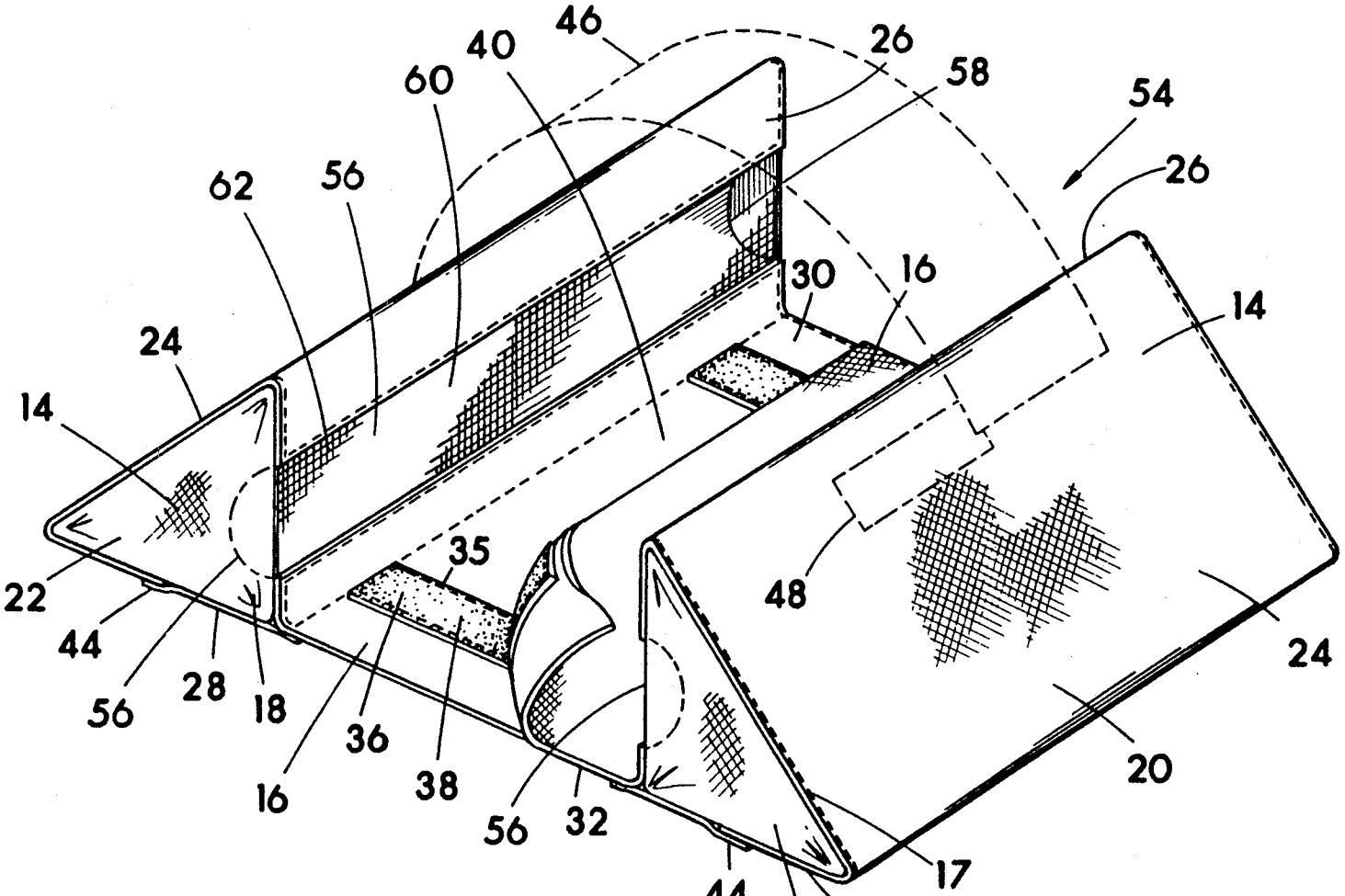
FIG. 5 is a perspective top view of slightly modified embodiment from that of FIG. 1, illustrating the elongated recesses of the ventilation system in both vertical side walls of the channel, showing each recess covered with netting or net material.
Figure 6:
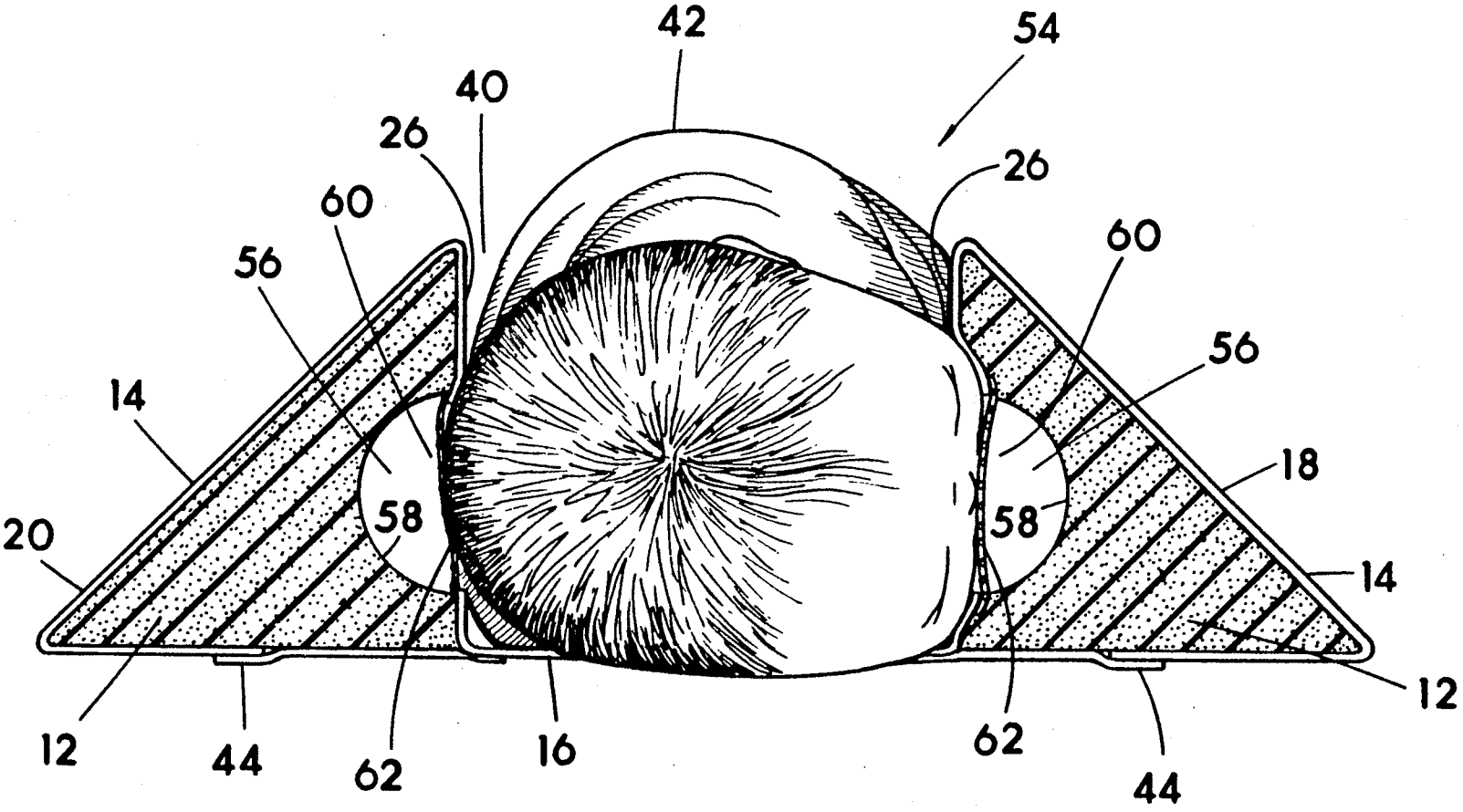
FIG. 6 is an in-use end view of the embodiment of FIG. 5 illustrating the pads in cross-section to illustrate the placement of the infant's face adjacent the netting covering the elongated recess. The rather tightly affixed netting is shown assisting in preventing the recess from being closed or blocked by the baby or its blanket, and the baby's nose and mouth are kept from abutting the interior wall defining the recess by the netting. The straight, flat surfaces below and above the recesses render the side wall containing the recess "effectively" planar for the purpose of properly stabilizing the infant.
Figure 7:
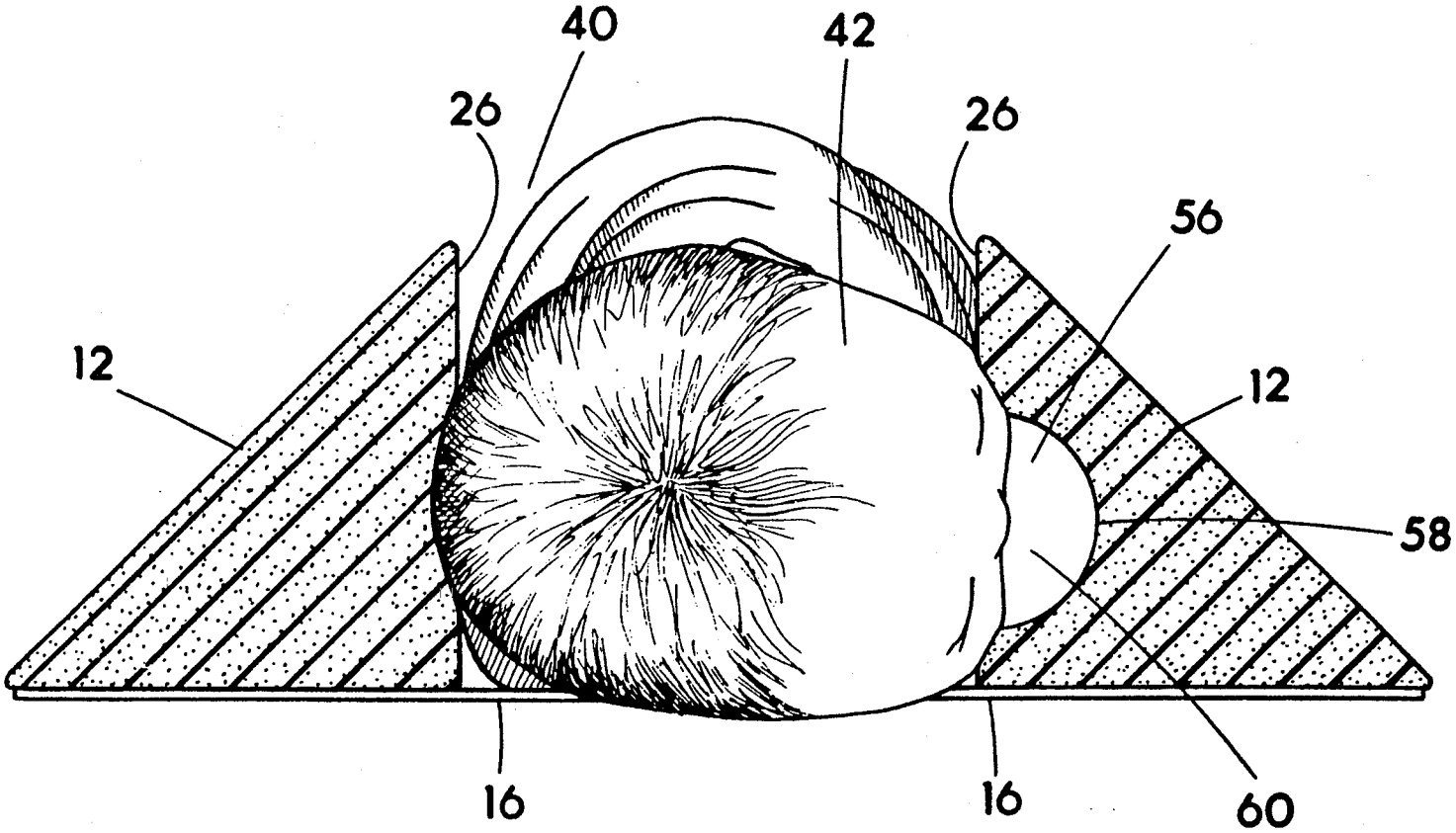
FIG. 7 is an in-use end view of an embodiment of the invention illustrating the foam members which are not covered by a thin sheet material, and which are shown in cross-section to illustrate the placement of the infant's face adjacent a ventilation recess which is not covered by netting or some over porous thin sheet material, but is sized and place to exclude the infant's face and prevent the nose and mouth of the infant from abutting the interior wall defining the recess. The straight, flat surfaces below and above the recess render the side wall containing the recess "effectively" planar for the purpose of properly stabilizing the infant.
Figure 8:
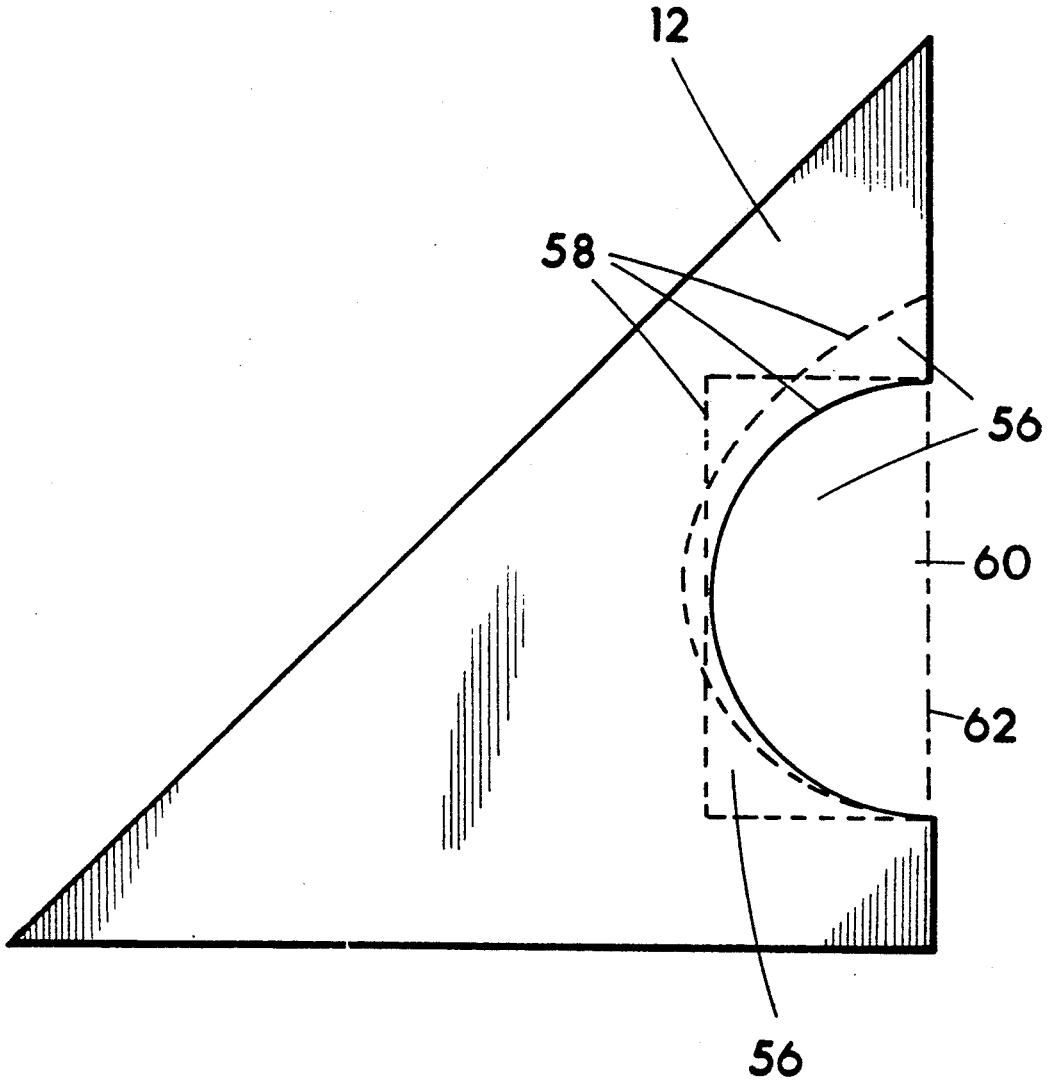
FIG. 8 is an end view of the foam pad of the embodiments having the ventilation system, illustrating in dotted outline some of the various possible shapes of the recess, and the phantom line representing the position of the netting if used.

Another variation of the present invention, embodiment 54, shown in FIGS. 5, 6, and 7, may be structured identical to infant support pillow 10 except for the possible shortening of the looped section 36 of hook and loop fastening strips 34 on main section 18, and the addition of the ventilation system which includes the excluding arrangement. The ventilation system which in this example includes an elongated lengthwise ventilation recess 56 in the vertical side wall 26, preferably in each foam member 12. Ventilation recesses 56 may of course be applied to support pillow 10 since support pillow 10 and support pillow 54 are essentially in principle the same. Recesses 56, in this example as depicted in FIGS. 5 and 6, are semi-circular elongated grooves, however other suitably shaped grooves such as rectangular or oval, as indicated in FIG. 8, may also be acceptable. I have also considered that foam members 12 could be fashioned with multiple convolutions, as possible alternatives to the single elongated horizontally disposed ventilation recess 56 in each of the vertical side walls 26. In the example shown, each elongated recess 56 extends the full length of each foam member 12, parallel to the bottom edge near panel 16, and the ends of the recesses 56 preferably open through each of the two oppositely disposed ends 22 of each of the foam members 12 so as to transfer heat out of the ends of the members 12 and away from the baby. With the openings of the recesses 56 properly positioned in the end walls 22, and the openings sized properly relative to the size of the typical baby's face, so that the baby's face cannot fully enter the recess 56, then whether or not netting 62 is placed over the recess 56, due to the size and placement of the recesses 56 relative to the size and expected normal placement of the baby's nose and mouth, should the baby slip downward, the nose and mouth of the baby will not be able to be pressed against any solid surface such as the interior wall 58 which defines each recess 56, which might otherwise somewhat block his breathing. Each recess 56 includes the surface or interior wall 58, which is merely the concave surface or wall within the foam member 12, and an open area or opening 60 which faces channel 40. The distance inward from the otherwise flat side wall 26 which surface 58 exists should be factored-in when sizing and placing the recess 56 and the opening thereof in the end walls 22 of the foam members 12 to help ensure the baby's nose and mouth cannot be blocked in the unlikely event the baby slips downward, and netting 62 or some other porous thin sheet material is not stretched over the opening 60 of the recess 56. The sizing of the recesses 56 is not as critical when porous material such as netting 62 is stretched over the recesses 56. When porous sheet material is not stretched over the recesses 56, I have found that a 2.5 inch wide recess 56 starting about one inch up from panel 16 functions as desired on a 5 inch high side wall 26. These sizes are of course only approximate and given as one example, and could be varied substantially, but taking into account the typical size of a newborn's head, his width from arm to arm across his back when lying on his side, these approximate dimensions do work as desired. These dimensions leave a solid flat surface of side wall 26 both above and below the recess 56, with these solid flat surfaces rendering the side wall 26 effectively planar, with this being important to maintaining the infant in a lateral position between two side walls 26 without having to apply excessive clamping pressure to the infant to keep him from rotating out of the lateral position. An excessively large or wide recess 56 leaving insignificant flat solid surface on side wall 26, particularly at the upper end of the wall 26, would require excessive clamping pressure to the infant to keep him from rotating out of the lateral position.

The ventilation system using a properly sized and placed recess 56 will function without being covered with a porous thin sheet material. The opening 60 of each recess 56 is however preferably covered with a porous thin sheet material, such as fabric netting 62, which air passes through easily. Netting 62 in this example is an elongated rectangular section of material which replaces the section of fabric covering 14 positioned over each recess 56. Netting 62 is preferably sewn onto the edges of fabric covering 14 surrounding recess 56, although other methods of affixment such as adhesives can also be used. The section of fabric covering 14 over recesses 56 on the end walls 22, if fabric covering 14 is non-porous, should be replaced with netting 62 to provide better air circulation. Fabric materials such as terry-cloth and flannel are sufficiently porous that an infant can breathe through them, however, netting 62 is much more porous and Other alternative structures of embodiment 54 which are anticipated, include providing the entire fabric covering 14 in a sufficiently porous breathable material such as flannel or terry cloth. This would eliminate the need and possible expense of adding the extra netting 62, and would function adequately. Also anticipated is providing more rigidity to recess surface 58 with a spray-on plastic coating or the adhesion of a semi-rigid member conforming to surface 58, which would reduce the possible necessity of increasing the density and rigidity of foam members 12 to prevent the possible excessive deformation of recesses 56. Also anticipated, as may be ascertained from drawing FIG. 7, is providing an embodiment wherein foam members 12 are made of foam rubber which has preferably been dipped or sprayed with a rubbery coating or sealant, eliminating the need of any fabric covering 14, and rendering an easily cleaned surface, and this version could have at least one ventilation recess 56 most likely using the size and placement arrangement of excluding as opposed to the netting being placed over the recess 56. The "at least one ventilation recess 56" is feasible since the side on which the parent places the infant for sleeping is predictable, being determined by the parent, and in this case the parent need only position the infant's face toward the member 12 having the recess 56. In drawing FIG. 7, the panels 16 are sewn or glued directly to the bottoms of the foam members 12.

Another alternative structure in accordance with the present invention is to use a single separable bottom panel which would be, or include the soft side of the hook and loop fastener facing upward, as a replacement for rectangular panels 16. The single separable bottom panel would then releasably connect to the bottoms of the pads or foam members 12 which would include the hook side of the hook and loop fasteners attached to the underside. This arrangement would allow the foam members 12 to be stabilized relative to one another to define the channel, and to be repositioned on the single separable bottom panel and thus allow for the adjustment of the width of the channel.

Although I have very specifically described preferred structures of the invention, again, it should be understood that the specific details are just that, "preferred", and given only for example to those skilled in the art. Many changes in the specific structures described and shown may of course be made without departing from the true spirit and scope of my invention as recited in the appended claims.

What I claim as my invention is:

1. A support pillow structured for maintaining a human on its side, said support pillow comprising;

a first elongated member having at least a side wall connected to a base, a second elongated member having at least a side wall connected to a base, said support pillow including a channel, said channel having oppositely disposed sides defined by said side walls of the first member and the second member in spaced relationship to one another, the spacing between said side walls being sufficient for a human to lie between said side walls within said channel, at least one of said side walls having at least one recess therein, there being excluding means for excluding a human's face from fully entering said recess and the human's nose and mouth from engaging a wall defining said recess.

2. A support pillow according to claim 1 wherein said excluding means includes said recess being sized sufficiently narrow and sufficiently deep so as to exclude a human's face from fully entering said recess and the human's nose and mouth from engaging a wall defining said recess.

3. A support pillow according to claim 1 wherein said excluding means includes said recess covered with porous thin sheet material stretched sufficiently tight so as to leave said recess open behind said porous thin sheet material.

4. A support pillow structured for maintaining a human on its side, said support pillow comprising;

a first main section and a second main section, said first main section comprising an elongated flexible and resilient member having at least a generally vertically disposed side wall connected to a horizontally disposed base, a panel extending from and beyond an intersection of said vertically disposed side wall and said horizontally disposed base, said panel having a top surface and an oppositely disposed bottom surface, said top surface of said panel affixed with a first portion of a fastener means;

said second main section comprising an elongated flexible and resilient member having at least a generally vertically disposed side wall connected to a substantially horizontally disposed base, a panel extending from and beyond an intersection of said vertically disposed side wall and said horizontally disposed base, said panel of said second main section having a top surface and an oppositely disposed bottom surface, said bottom surface of said panel of said second main section affixed with a second portion of fastener means releasably attached to said first portion of fastener means of said first main section with said panels of said first and second main sections overlapped, the overlapped panels in combination with said horizontally disposed bases of said first and second main sections providing a generally flat anti-roll bottom on said support pillow, said support pillow including a channel having an open top and two oppositely disposed open ends, a bottom of said channel defined by the overlapped panels, said channel having oppositely disposed sides defined by said vertically disposed side walls of said first and second main sections positioned in spaced relationship to one another, the first and second portions of said fastener means further including means for allowing small increment adjustments in the spacing between the vertically disposed side walls and thus in the width of said channel, at least one of said vertically disposed side walls having at least one recess therein, there being excluding means for excluding a human's face from fully entering said recess and the human's nose and mouth from engaging a wall defining said recess.

5. A support pillow according to claim 4 wherein said excluding means includes said recess being sized sufficiently narrow and sufficiently deep so as to exclude a human's face from fully entering said recess and the human's nose and mouth from engaging a wall defining said recess.

6. A support pillow according to claim 4 wherein said excluding means includes said recess covered with porous thin sheet material stretched sufficiently tight so as to leave said recess open behind said porous thin sheet material.

7. A support pillow structured for maintaining a human on its side while sleeping, said support pillow comprising;

a first main section and a second main section, said first main section comprising an elongated member of a flexible and resilient nature, said member wrapped within an outer thin sheet material to define a resilient pad, said pad having at least a substantially vertically disposed side wall connected to a substantially horizontally disposed generally flat base, said thin sheet material further extending from and beyond an intersection of said vertically disposed side wall and said horizontally disposed base to define a substantially flat panel, said panel having a top surface and an oppositely disposed bottom surface, said top surface of said panel affixed with at least one hook and loop fastening member, said second main section comprising an elongated member of a flexible and resilient nature, said member of said second main section wrapped within an outer thin sheet material to define a resilient pad, said pad of said second main section having at least a substantially vertically disposed side wall connected to a substantially horizontally disposed generally flat base, said thin sheet material of said second main section further extending from and beyond an intersection of said vertically disposed side wall and said horizontally disposed base of said second main section to define a substantially flat panel, said panel of said second main section having a top surface and an oppositely disposed bottom surface, said bottom surface of said panel of said second main section affixed with at least one hook and loop fastening member releasably mated to said hook and loop fastening member of said first main section with said panels of said first and second main sections overlapped, the overlapped panels in combination with said horizontally disposed generally flat bases of said first and second main sections providing a substantially flat anti-roll bottom on said support pillow, said support pillow including a channel having an open top and two oppositely disposed open ends, a bottom of said channel defined by the overlapped panels, said channel having oppositely disposed sides defined by said vertically disposed side walls of said first and second main sections positioned generally parallel to one another and further in spaced relationship to one another, said hook and loop fasteners of the panels of said first and second main sections positioned and sized relative to one another and relative to the vertically disposed side walls so as to allow for small increment adjustments in the spacing between the vertically disposed side walls and thus in the width of said channel, ventilation means, said ventilation means including at least one of said vertically disposed side walls having at least one recess therein, there being excluding means for excluding a human's face from fully entering said recess and the human's nose and mouth from engaging a wall defining said recess.

8. A support pillow according to claim 7 wherein said excluding means includes said recess being sized sufficiently narrow and sufficiently deep so as to exclude a human's face from fully entering said recess and the human's nose and mouth from engaging a wall defining said recess.

9. A support pillow according to claim 7 wherein said excluding means includes said recess covered with porous thin sheet material stretched sufficiently tight so as to leave said recess open behind said porous thin sheet material.

10. A support pillow according to claim 9 wherein said porous thin sheet material is netting.

11. A support pillow according to claim 10 wherein said member is made of a foamed plastic.

12. A support pillow according to claim 11 wherein said member is right triangular in shape.

* * * * *